US005586516A

United States Patent [19]

Hagen et al.

[11] Patent Number: 5,586,516

[45] Date of Patent: Dec. 24, 1996

[54] RELATING TO BOARDING RAMPS

[75] Inventors: Urs A. Hagen, Eggenran; Martin Schmid, Banhofstrasse, both of Switzerland; Gwyn P. Owen, Clwyd, Great Britain

[73] Assignee: Services Algoa International Anstalt, Switzerland

[21] Appl. No.: 523,409

[22] Filed: Sep. 5, 1995

[30] Foreign Application Priority Data

Sep. 6, 1994 [GB] United Kingdom ..... 9417949

[51] Int. Cl.[6] ..... B63B 17/00

[52] U.S. Cl. ..... 114/362

[58] Field of Search ..... 114/343, 362, 114/270, 230, 249, 251, 222

[56] References Cited

U.S. PATENT DOCUMENTS 2,641,785 6/1953 Pitts et al. ..... 114/362

4,949,663 8/1990 Lapeyre ..... 114/249

FOREIGN PATENT DOCUMENTS 2821172 11/1978 Germany ..... 114/362

1279904 12/1986 U.S.S.R. ..... 114/362

*Primary Examiner*—Stephen Avila

*Attorney, Agent, or Firm*—Anthony J. Casella; Gerald E. Hespos

[57] ABSTRACT

The present specification describes a boarding ramp which, in use, is pivotally secured to a waterborne craft said boarding ramp comprising an elongate passageway. One end region of the passageway is pivotally attached to a waterborne craft, and a hydraulic ram is connected to the passageway and to the craft. In use, the ram controls pivotal movement of the passageway, and a magnet is arranged on the other end region of the passageway for use in securing the said other end region of the passageway to an unloading location.

11 Claims, 3 Drawing Sheets

RELATING TO BOARDING RAMPS

The present invention relates to a boarding ramp for use in providing access to and from a vehicle.

More particularly the present invention relates to a boarding ramp which can be used to provide access to and from a waterborne vehicle such as a boat or hovercraft especially at offshore structures such as, for example, drilling rigs, production platforms, gathering stations, well jackets, well protectors, well platforms, gas injection platforms, water injection platforms, well caissons and helideck platforms.

Conventionally boats and helicopters are used to ferry people and freight to offshore structures with the helicopters actually landing on the offshore structures to allow for unloading and loading. When a boat is used it can be moored using ropes to a boat landing deck on the offshore structure though such mooring can be difficult and dangerous dependent upon the sea conditions. More usually people and freight are unloaded and loaded using a crane on the offshore structure, it then being possible for the boat to merely stand off the offshore structure. Hovercraft are not however usually used to ferry people and freight to an offshore structure even though they are considerably faster than a boat and can carry a larger payload than a helicopter. This is because it is not usually possible to moor a hovercraft to an offshore structure in view of the probability of the inflatable skirt of the hovercraft being damaged, and offloading/loading by crane is inappropriate due to the particular shape and design of a hovercraft which parameters are primarily dictated by speed.

An aim of the present invention is to provide a boarding ramp which can be used on a boat or a hovercraft both to allow for ready access and mooring of the boat or hovercraft.

According to the present invention there is provided a boarding ramp which, in use, is pivotally secured to a waterborne craft, said boarding ramp comprising an elongate passageway, one end region of which is adapted to be pivotally attached to a waterborne craft, a hydraulic ram being connected to the passageway and connectible to the craft to, in use, control pivotal movement of the passageway, and a magnet being arranged on the other end region of the passageway for use in securing the said other end region of the passageway to an unloading location.

The boarding ramp of the present invention may be used to advantage on, for example, the foredeck of a boat to allow for unloading/loading of freight and people, with the magnet engaging and magnetically gripping a suitably located ferromagnetic plate permanently secured to a quayside or the boat landing deck of an offshore structure. The magnetically secured boarding ramp thus moors the boat as well as allowing for access. More especially the boarding ramp of the present invention may be used on a hovercraft to allow for mooring and access to a ferromagnetic plate secured to the boat landing deck of an offshore structure, the magnetically secured boarding ramp mooring the hovercraft at a distance from the boat landing deck to thus prevent damage to the inflatable skirt of the hovercraft.

In one embodiment of the present invention the magnet is an electromagnet which can be remotely activated from the boat or hovercraft, the hydraulic ram being likewise remotely controlled. Thus when approaching a docking position the hydraulic ram can be activated to pivot the passageway relative to the boat or hovercraft from a stored position on board, to a position wherein the other end region of the passageway is located over the docking position, the hydraulic ram being of the double acting type to provide for control in both pivotal directions. The electromagnet can then be activated to attract and secure the electromagnet to a ferromagnetic plate permanently fixed at the docking position. The passageway which preferably is substantially horizontal in the docked/moored position preferably has a handrail on one or both sides to facilitate use. The handrail may be collapsible when the ramp has been pivoted to the stored position.

To allow for movement of the boat or hovercraft due to the sea state, the hydraulic ram is preferably provided with a bypass preferably controlled by a solenoid valve. Thus when the electromagnet has been energised and is gripping the docking position, the solenoid valve may be opened so that the boarding ramp may pivot relative to the boat or hovercraft in response to the sea swell. By limiting the cross-section of the bypass the movement of the boat/hovercraft ie. the pivotal movement of the ramp, can be damped.

Further, to cater for the movement of the boat/hovercraft in response to the sea swell, which movement can be in differing directions, the electromagnet is preferably attached to the said other end region of the passageway by a pivotal joint, preferably a universal joint or spherical bearing.

The passageway itself may be made as one unitary section, though preferably it is made of two sections, one section comprising an elongate flat surface and the other section comprising two regions fixed together at an obtuse angle. One of said regions is pivotally secured to the boat/hovercraft and the free end of the other region is pivotally attached to one end of said one section, the magnet being attached to the other end region of said one section. Said sections are pivotal relative to each other by a further double acting ram so that in a stored position said one region of said other section can lie along the deck with said one section pivoted to lie against said other region of said other section. When required the hydraulic rams are activated so that said sections pivot to a position wherein said one section and the other region of the other section are substantially coplanar and substantially horizontal, with said one region of said other section being angled to the deck and provided with steps to facilitate walking thereon. Preferably the steps are adjustable either manually or automatically so that they are each always horizontal in the in use position of the ramp. A collapsible handrail is also preferably provided in the said sections. Further, extra pivotal sections can be incorporated within the scope of the present invention.

In another embodiment of the present invention the passageway is additionally pivotal about a generally vertical axis so that the passageway may be pivoted about the generally vertical axis between an in use position and a stored position in which it preferably extends along a side deck of the craft. The passageway may thus be a rigid unitary construction if desired, or a multi-part construction as previously described.

The boarding ramp of the present invention thus provides a simple means of both mooring and providing access to a boat or hovercraft.

The present invention will now be further described, by way of example, with reference to the accompanying drawings, in which:

FIG. 1 is a side view of one embodiment of the present invention mounted on a hovercraft;

Figure 2:
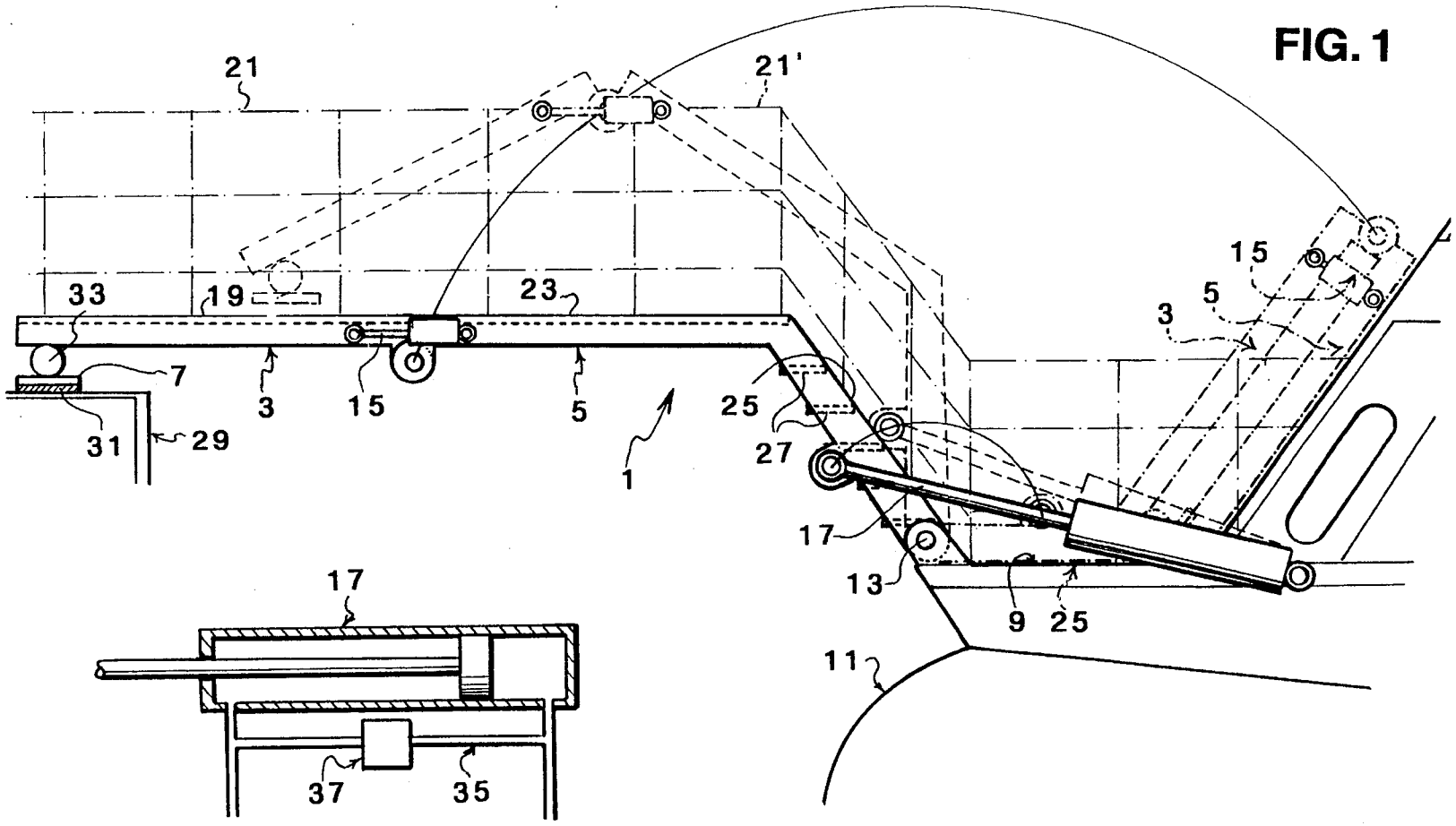
FIG. 2 is a schematic illustration of the double acting hydraulic ram and controlled bypass used for pivoting the embodiment of FIG. 1 relative to the hovercraft.

The embodiment of the present invention illustrated in FIGS. 1 and 2 of the accompanying drawings comprises a boarding ramp generally designated 1, which basically comprises two sections 3,5, one section 3 being provided with an electromagnet 7 for use in detachably securing the ramp to a mooring location, and the other section 5 being pivotally attached to the foredeck 9 of a hovercraft 11. The ramp can of course be equally well pivotally attached to the deck of a boat for like use.

Said sections 3,5 of the boarding ramp 1 are pivotally attached together as at 13 with a double acting hydraulic ram pivotally connected to both of said section 3,5 so as to control the relative desired pivotal motion of said sections 3,5. A further double-acting hydraulic ram 17 is connected pivotally to both said other section 5 of the ramp 1 and to the hovercraft 11. The hydraulic rams 15 and 17 are commonly controlled so that by remote energisation by the helmsman/pilot of the hovercraft, the boarding ramp can be moved from between a collapsed, stored position and an extended moored/ready for use position. Alternatively the hydraulic rams 15,17 can be separately controllable.

As seen in FIG. 1 of the accompanying drawings, said one section 3 of the boarding ramp 1 provides a passageway having a planar walkway 19 to either side of which is provided a safety hand rail 21. Said other section 5 provides a passageway having a planar walkway region 23 and an inclined walkway region 25, the inclined walkway region 25 having steps 27 which are adjustable either as desired or automatically to provide horizontal steps as and when the walkway is ready for use, thus facilitating loading and unloading of the hovercraft. This other section 5 is also provided on each side with a safety handrail 21', the handrails 21,21' being foldable ie. collapsible as the ramp is pivoted to a closed stored position.

As seen in FIG. 1 in dashed lines, the boarding ramp 1 in its stored positions lies with the inclined walkway region 25 along the foredeck 9 and said one section 3 folded behind the planar region 23 of said other section 5. When the hovercraft approaches a mooring/docking location 29 on an offshore structure, the helmsman/pilot can activate the hydraulic rams 15,17 so that the ramp 1 unfolds, eventually attaining an extended ready-for-use position as illustrated in FIG. 1, wherein the electromagnet 7 is located over a ferromagnetic plate 31 at the mooring location 29. By energising the electromagnet 7 the ramp 1 engages and is secured to plate 31 at the mooring location 29, the ramp 1 thus both providing for the unloading and loading of the hovercraft with people and/or freight, and securely mooring the hovercraft to the mooring location with the hovercraft being spaced therefrom so that it is safe from damage due to collision or rubbing against the offshore structure. To allow for movement of the hovercraft and boarding ramp relative to mooring location 29 due to, for example, sea swell, the electromagnet 7 is attached to said one section 3 of the ramp 1 by a universal joint 33 such as a ball joint. Thus the electromagnet can be secured in planar contact with plate 31 whilst the hovercraft can move in varying directions.

To further cater for hovercraft movement due to the sea state, the hydraulic ram 17 is provided with a bypass 35, the throughflow cross-section of which is controlled by a solenoid valve 37—see FIG. 2. As and when the electromagnet 7 has been energised and secured to the mooring location 29, the solenoid valve 37 can be energised to open the bypass 35. The hydraulic ram 15 can thus then freely extend and retract as necessary, allowing the ramp 1 to pivot relative to the foredeck 9 as the sea state dictates. By restricting the flow of the hydraulic fluid through the bypass 35 by the provision of a restrictor (not shown) or the mere dimensioning of the bypass 35, the free extension/retraction movement of the ram 15 is dampened.

Figure 3:
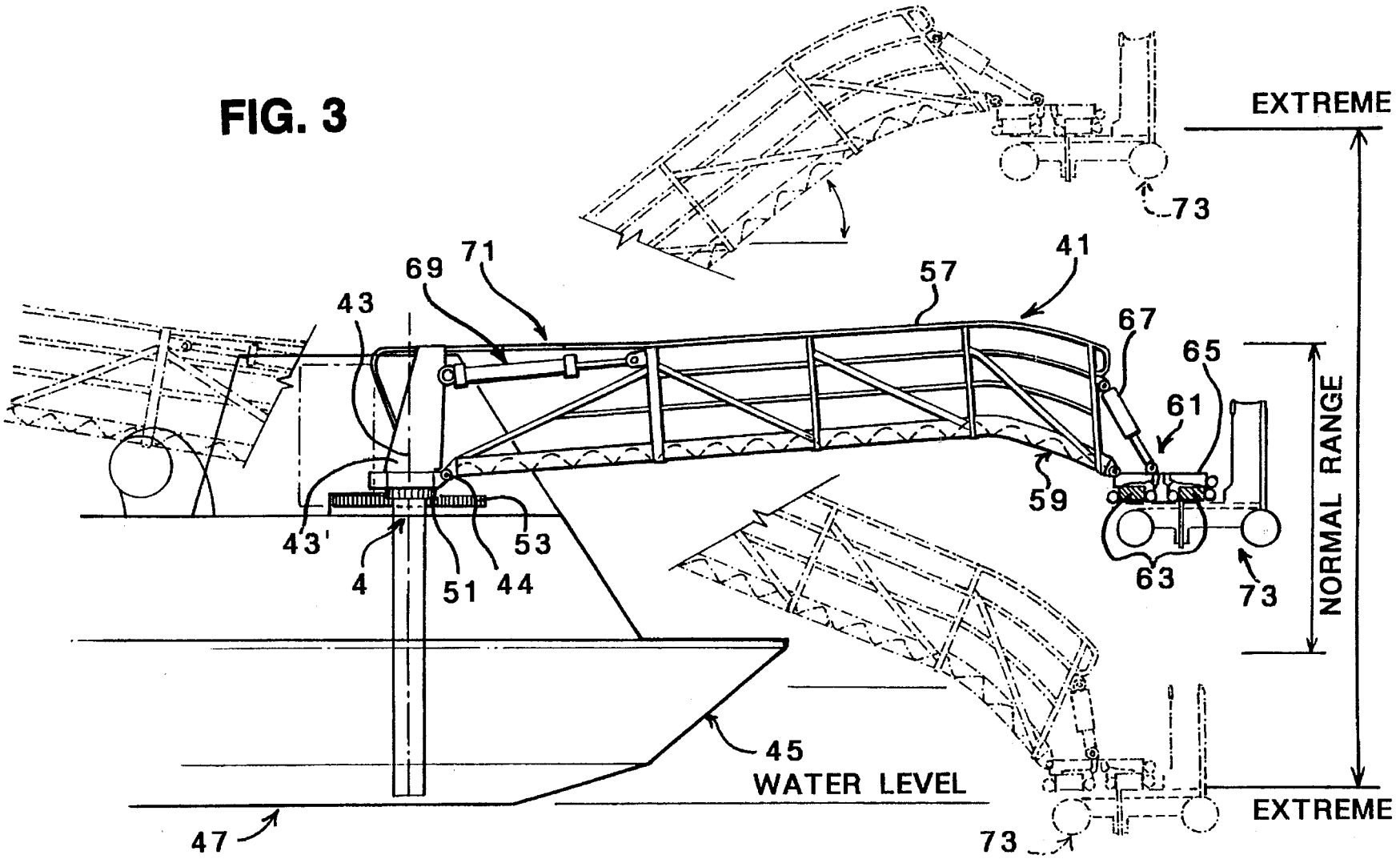
FIG. 3 is a side view of another embodiment of the present invention.
Figure 4:
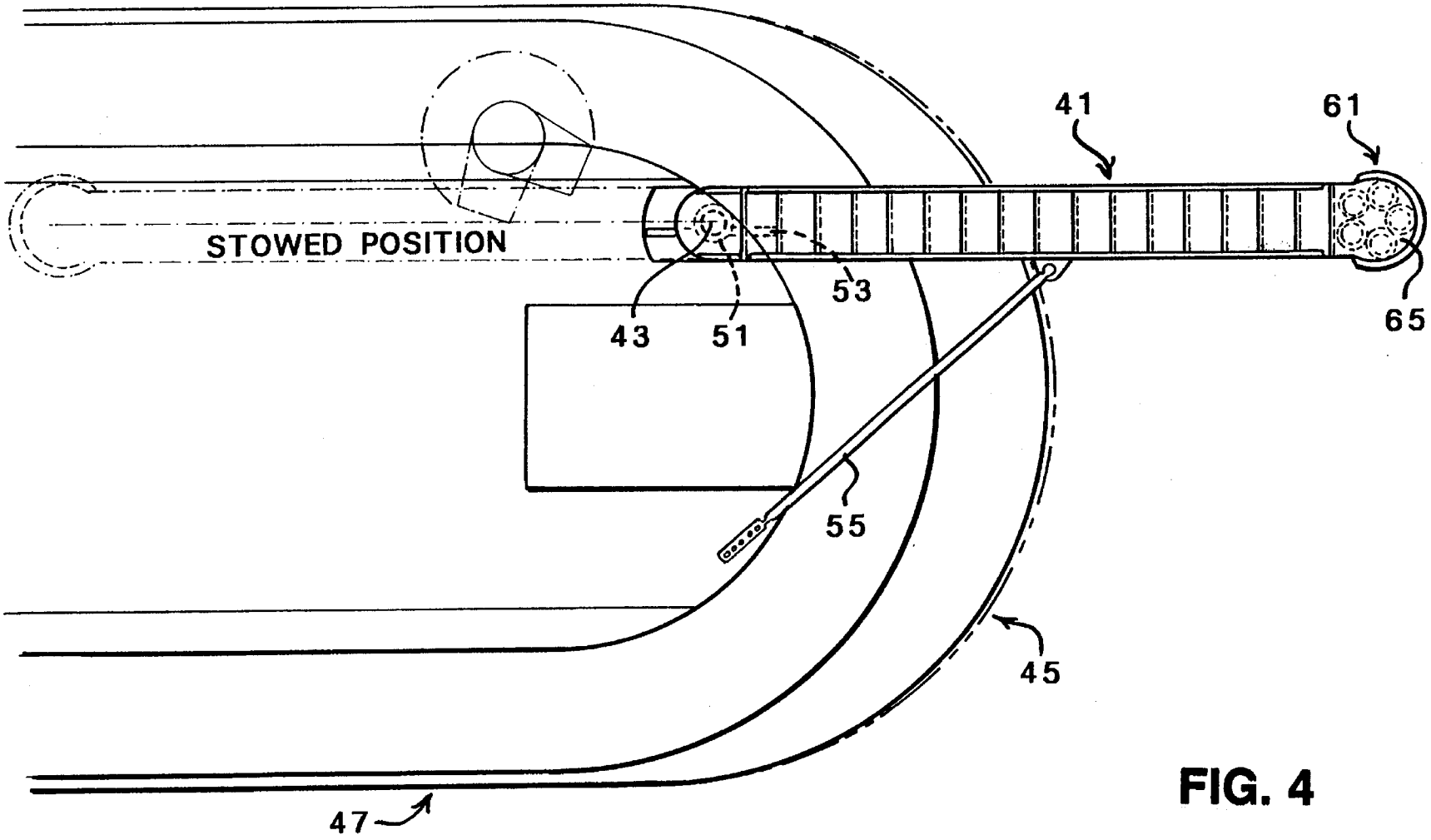
FIG. 4 is a plan view of the embodiment of FIG. 3.

FIGS. 3 and 4 of the accompanying drawings illustrate another embodiment of the present invention. The major difference between this embodiment and the embodiment of FIGS. 1 and 2 lies in the arrangement of the end region 39 of the passageway 41 to be pivotal about a substantially vertical axis 43 as well as substantially horizontal axis 44, the passageway in the embodiment of FIGS. 1 and 2 being solely pivotal about a substantially horizontal axis. Further the passageway 41 is a unitary construction though if desired it could be alternatively constructed in a number of hinged sections controlled as in the embodiment of FIG. 1. Said one end region 39 of the passageway 41 is mounted adjacent the bow region 45 of the hovercraft 47, to one side of the hovercraft. Thus when required to be stored when not in use the passageway 41 can be pivoted about the substantially vertical axis 43 to be along the side deck of the hovercraft 47. This pivotal motion about the substantially vertical axis 43 is effected by a motor driven rack and pinion arrangement 49. To explain said one end region 39 of the passageway 41 is mounted on a substantially vertical axle 43' which is rotatably mounted in the decking of the hovercraft 47. The axle 43' has a pinion 51 formed coaxially therewith, which pinion 51 meshes with an axially slidable rack 53, the rack 53 being axially movable under the action of one or more double acting hydraulic rams (not illustrated). Thus by sliding the rack 53 axially the pinion 51 and axle 43' are rotated causing the passageway to pivot between a stored and an in-use position. When in the in-use position of FIG. 4 a brace 55 can secure the passageway 41 in this position to avoid the rack and pinion 49 from being subjected to any large forces which may arise due to the sea state when moored.

As best seen in FIG. 3 the passageway 41 has fixed railings 57, and the free end region 59 carries a pivotal magnet arrangement 61. Alternatively, if desired the railings can be collapsible. The magnet arrangement 61 has five electromagnets 63 located in a structure which has a generally planar upper surface 65, one end region of the surface/structure being pivotally attached to the face end region 59 of the passageway 41, with the pivotal axis being substantially horizontal. A double acting hydraulic ram 67 extends, between the fixed railings 57 and the magnet arrangement 61 to control the position of the planar surface 65 as the passageway is moved to and from an in use moored position. Also a further double acting hydraulic ram 69 extends between the fixed railings 57 and said axle 43' to pivot the passageway generally vertically as required. To allow for this generally vertical movement a telescopic section 71 of railing extends between the fixed railing 57 and the axle 43'.

During travel between desired locations the passageway 41 is stored along the side deck of the hovercraft—see FIG. 4. The passageway can be secured in this stowed position by suitable retaining means and/or by the magnet arrangement 61 gripping an appropriate deck location and/or by the effective locking of the hydraulic rams in appropriate positions.

When a destination is approached the passageway 41 is released and hydraulic ram 69 retracted to slightly lift the passageway 41 off the deck. The rack and pinion arrangement 49 is then activated to pivot the passageway 41 to project over the bow region of the hovercraft. Then by control of the respective rams 67 and 69 the desired elevation of the free end region of the passageway 41 and the magnet arrangement 61 is selected, FIG. 3 showing the normal range and the extreme possible positions. When appropriate the magnet arrangement can be engaged with the quay 73 and energised the relevant rams 67 and 69 passing into open circuit as previously described with regard to FIG. 2. The brace 55 can then be attached and adjusted in length.

The present invention thus provides a simple but effective boarding/mooring facility which can be advantageously used with both a boat and a hovercraft, but especially with a hovercraft utilised for ferrying people and freight to and from an offshore structure.

We claim:

1. A boarding ramp which, in use, is pivotally secured to a waterborne craft, said boarding ramp comprising an elongated passageway, one end region of which is adapted to be pivotally attached to the waterborne craft, a hydraulic ram being connected to the passageway and connectable to the craft to, in use, control pivotal movement of the passageway, a controllable bypass connected across the hydraulic ram, a solenoid valve disposed and operative for controlling said controllable bypass, and an electromagnet being arranged on the other end region of the passageway for use in securing said other end region of the passageway to an unloading location.

2. A boarding ramp according to claim 1, wherein said one end region of the elongate passageway is pivotal about a substantially horizontal axis.

3. A boarding ramp according to claim 1, wherein said one region of the elongate passageway is pivotal about a substantially vertical axis.

4. A boarding ramp according to claim 3, wherein a rack and pinion arrangement controls the pivotal movement about a generally substantially vertical axis.

5. A boarding ramp according to claim 1, wherein the electromagnet is arranged to be remotely controlled.

6. A boarding ramp according to claim 1, wherein the magnet is pivotally attached to said other end region of the ramp.

7. A boarding ramp according to claim 1, wherein the hydraulic ram is a double acting ram arranged to be controlled from a remote location.

8. A boarding ramp according to claim 1, wherein a handrail is provided on the passageway.

9. A boarding ramp according to claim 1, wherein the passageway is of unitary construction.

10. A boarding ramp according to claim 1, wherein the passageway is constructed in at least two sections, said sections being hinged together with further hydraulic rams being provided to control the relative hinged positions of said sections.

11. A boarding ramp which, in use, is pivotally secured to a waterborne craft, said boarding ramp comprising an elongated passageway, one end in the region of which is adapted to be pivotally attached to the waterborne craft, a hydraulic ram connected to the passageway and connectable to the craft to, in use, control pivotal movement of the passageway, a controllable bypass connected across the hydraulic ram, a solenoid valve disposed and operative for controlling said controllable bypass, and a remotely controlled electromagnet arranged on the other end region of the passageway for use in securing the other end region of the passageway to an unloading location, wherein the controllable bypass is coupled to the electromagnet so that when the electromagnet has been energised the bypass is opened.

* * * * *

UNITED STATES PATENT AND TRADEMARK OFFICE

CERTIFICATE OF CORRECTION

PATENT NO. : 5,586,516

DATED : December 24, 1996

INVENTOR(S) : Urs Arnold Hagen, Martin Schmid and Gwyn Peredur Owen

It is certified that error appears in the above-identified patent and that said Letters Patent is hereby corrected as shown below:

On the title page, item [54] and column 1, line 1, correct the title of the invention to read --BOARDING RAMP--.

Signed and Sealed this

Twelfth Day of May, 1998

*Attest:*

*Attesting Officer*

BRUCE LEHMAN

*Commissioner of Patents and Trademarks*